US011021280B2

(12) United States Patent
Grus et al.

(10) Patent No.: US 11,021,280 B2
(45) Date of Patent: Jun. 1, 2021

(54) FORMER CHUTE

(71) Applicant: TNA Australia Pty Limited, Lidcombe (AU)

(72) Inventors: Marek Grus, Springwood (AU); Darren Ken Alchin, Holsworthy (AU)

(73) Assignee: TNA Australia Pty Limited, Lidcombe (AU)

( * ) Notice: Subject to any disclaimer, the term of this patent is extended or adjusted under 35 U.S.C. 154(b) by 208 days.

(21) Appl. No.: 15/700,509

(22) Filed: Sep. 11, 2017

(65) Prior Publication Data

US 2018/0086487 A1 Mar. 29, 2018

(30) Foreign Application Priority Data

Sep. 12, 2016 (AU) ..... 2016903655

(51) Int. Cl.
*B65B 9/22* (2006.01)
*B65B 39/00* (2006.01)
*B65B 31/04* (2006.01)

(52) U.S. Cl.
CPC ..... *B65B 9/22* (2013.01); *B65B 31/045* (2013.01); *B65B 39/007* (2013.01)

(58) Field of Classification Search
CPC ..... B65B 9/22; B65B 39/007; B65B 31/045
USPC ..... 53/548, 562, 574, 576, 578; 493/186, 493/189, 302
See application file for complete search history.

(56) References Cited

U.S. PATENT DOCUMENTS 300,691 A * 6/1884 Brown ..... B67C 11/02 141/339
1,265,381 A * 5/1918 Ramey ..... B67C 11/02 141/339
1,662,147 A * 3/1928 Farden ..... B67C 11/02 141/339
2,250,910 A * 7/1941 Hiett ..... B60R 17/00 141/106

(Continued)

FOREIGN PATENT DOCUMENTS

DE 10 2006 059 003 A1 6/2008
EP 2 465 782 A1 6/2012

(Continued)

OTHER PUBLICATIONS

Spanish Search Report dated Mar. 27, 2018 in related Spanish Application No. 201731075 (five pages).

(Continued)

*Primary Examiner* — Hemant Desai
*Assistant Examiner* — Jacob A Smith
(74) *Attorney, Agent, or Firm* — Kilpatrick Townsend & Stockton LLP

(57) ABSTRACT

A former assembly (10) for a packaging machine. The former assembly (10) includes a frame (11) that supports a former shoulder (17). The former shoulder (17) has a former opening (20) that is aligned with a tubular delivery chute (21). Product is delivered to the chute (21), from where product is delivered to the opening (20) and therefore the former shoulder (17). The delivery chute (21) has an interior (22) having a plurality of projections (44) in the form of ridges (45). The ridges are located at angular positions spaced about the generally central axis (19) and have their major direction of extension downward.

17 Claims, 3 Drawing Sheets

(56) References Cited

U.S. PATENT DOCUMENTS

| | | | | |
|---|---|---|---|---|
| 3,326,097 | A | 6/1967 | Lokey | |
| 4,043,098 | A | 8/1977 | Putnam, Jr. et al. | |
| 4,444,283 | A * | 4/1984 | Mikami | G01G 21/28 177/128 |
| 4,554,687 | A * | 11/1985 | Carter | G01F 1/52 4/144.1 |
| 4,753,336 | A | 6/1988 | Taylor et al. | |
| 4,792,031 | A * | 12/1988 | Warner | B65B 39/007 141/339 |
| 5,255,497 | A | 10/1993 | Zoromski et al. | |
| 5,385,180 | A * | 1/1995 | Wittman | B67C 11/02 141/106 |
| 5,551,208 | A | 9/1996 | Van Erden | |
| 5,622,032 | A | 4/1997 | Ryan | |
| 5,765,655 | A * | 6/1998 | Tatsuoka | G01G 13/16 177/105 |
| 6,903,279 | B2 * | 6/2005 | Taylor | G01G 13/16 177/25.18 |
| 7,128,204 | B2 * | 10/2006 | Baranowski | G01G 19/393 198/752.1 |
| 7,152,387 | B2 * | 12/2006 | Taylor | B65B 31/045 53/511 |
| 7,159,376 | B2 | 1/2007 | Taylor | |
| 9,598,189 | B2 | 3/2017 | Taylor | |
| 10,801,880 | B2 * | 10/2020 | Takeichi | G01G 13/18 |
| 2006/0207221 | A1 * | 9/2006 | Ausnit | B65B 61/188 53/412 |
| 2008/0229712 | A1 * | 9/2008 | Dominguez | B65B 9/22 53/415 |
| 2009/0223596 | A1 | 9/2009 | Wang | |
| 2010/0101682 | A1 * | 4/2010 | Barber | B65B 39/007 141/331 |
| 2012/0233970 | A1 * | 9/2012 | Taylor | B65B 9/22 53/545 |
| 2015/0274339 | A1 * | 10/2015 | An | B65B 57/00 53/493 |

FOREIGN PATENT DOCUMENTS

| | | | |
|---|---|---|---|
| EP | 2 484 595 | A1 | 8/2012 |
| ES | 2 311 782 | T3 | 2/2009 |
| ES | 2 401 267 | A1 | 4/2013 |
| GB | 190102651 | A | 5/1901 |
| GB | 1 440 816 | A | 6/1976 |
| JP | S59-186201 | U | 10/1984 |

OTHER PUBLICATIONS

British Search Report dated Feb. 7, 2018 from corresponding British Application GB 1714315.7. (two pages).

British Examination Report dated Nov. 19, 2020, of the corresponding British Patent Application No. GB 1714315.7. (five pages).

* cited by examiner 45
42
19
41
44
21
40

43
19
41
40
45
44
42

42
45
43
41
44
40
41
45
42

42
43
19
40

FORMER CHUTE

FIELD

The present invention relates to formers for packaging machines.

BACKGROUND

Disclosed in U.S. patent application Ser. No. 13/421,596, lodged on 15 Mar. 2012 is a former for a packaging machine.

Formers are employed to receive bag material in strip form, and reconfigure the strip into tubular bag material for delivery to a packaging machine. Product is delivered to the interior of the tube with the packaging machine then forming transverse seals and transversely cutting the bag material to form bags of product. As a particular example, the product may be a snack food such as a potato crisps.

A former assembly includes a mounting plate to which there is attached a metal sheet that provides the former surface over which the strip bag material passes to be reconfigured into a tubular configuration. The former surface converges upwardly to an upper opening through which there projects a product tube, via which product is delivered to the interior of the bag material. Above the former is a former chute (tube).

Located above the former chute is a weighing machine that delivers batches of product to the tube for delivery to the interior of the tubular bag material. The weighing machine includes a plurality of buckets, spaced angularly about a generally upright axis. The buckets are open to deliver a desired quantity of product to form a batch, to be located in a bag to be formed. As the batches travel downwardly, the batches elongate. This elongation of the batches results in the packaging machine below being operated at limited speed. A further disadvantage is that as batches traveling downward, they are slowed further exacerbating the disadvantage of batch elongation.

Disadvantages of the above discussed assemblies are that they cause batch elongation and reduce batch speed.

OBJECT

It is the object of the present invention to overcome or substantially ameliorate the above disadvantage.

SUMMARY OF THE INVENTION

There is disclosed herein a former assembly for a packaging machine, the assembly including:

a frame to be fixed relative to the packaging machine so that the assembly can deliver tubular bag material to the packaging machine;

a former shoulder mounted on the frame, the former shoulder being provided to receive strip bag material and reconfigure the strip material into the tubular bag material, the former shoulder includes a former surface over which the strip material passes to be reconfigured, the former surface converging upwardly to a former opening through which tubular bag material passes;

a product delivery chute extending downwardly to adjacent the opening and via which product is delivered to the interior of the tubular bag material; and wherein the product delivery chute and former shoulder have a generally upright central longitudinal axis, with product flowing downwardly through the delivery chute to the former shoulder, with the delivery chute having an internal chute surface surrounding said axis, with said chute surface having a plurality of projections having a direction of extension generally parallel to said axis, that inhibit angular movement of product about said axis as product falls through the chute.

Preferably, the projections are located at angularly spaced positions about said axis.

Preferably, each projection has a major direction of extension generally parallel to said axis, and a minor direction radially relative to said axis.

Preferably, said surface converges downwardly toward said axis.

Preferably, said chute surface is generally circular in transverse cross-section.

Preferably, each projection is a ridge extending inwardly toward said axis.

Preferably, each ridge does not extend angularly about said axis.

Preferably, said delivery chute includes a tube body providing said surface, with each projection being attached to said body.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
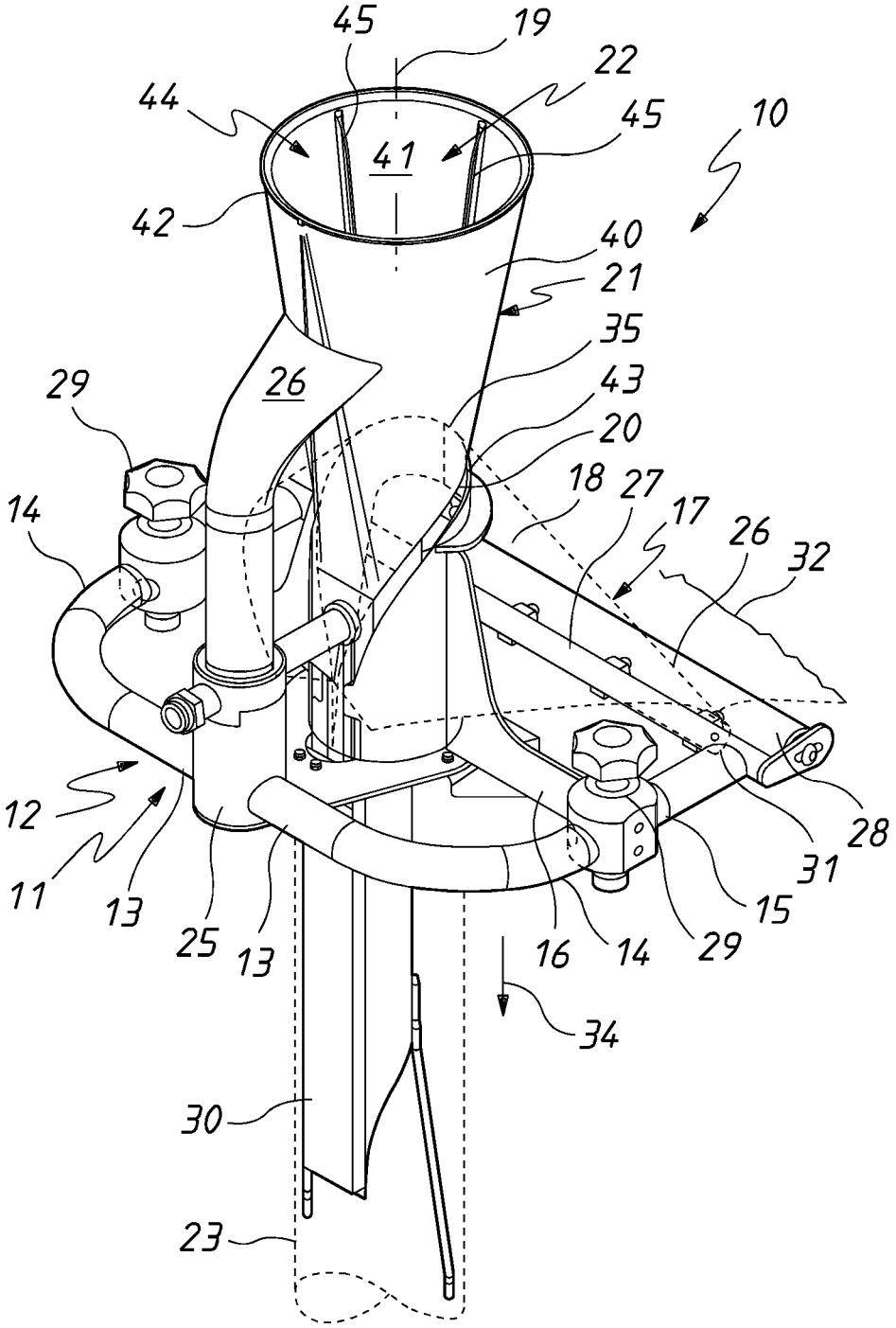
FIG. 1 is a schematic isometric view of a former assembly for a packaging machine.
Figure 2:
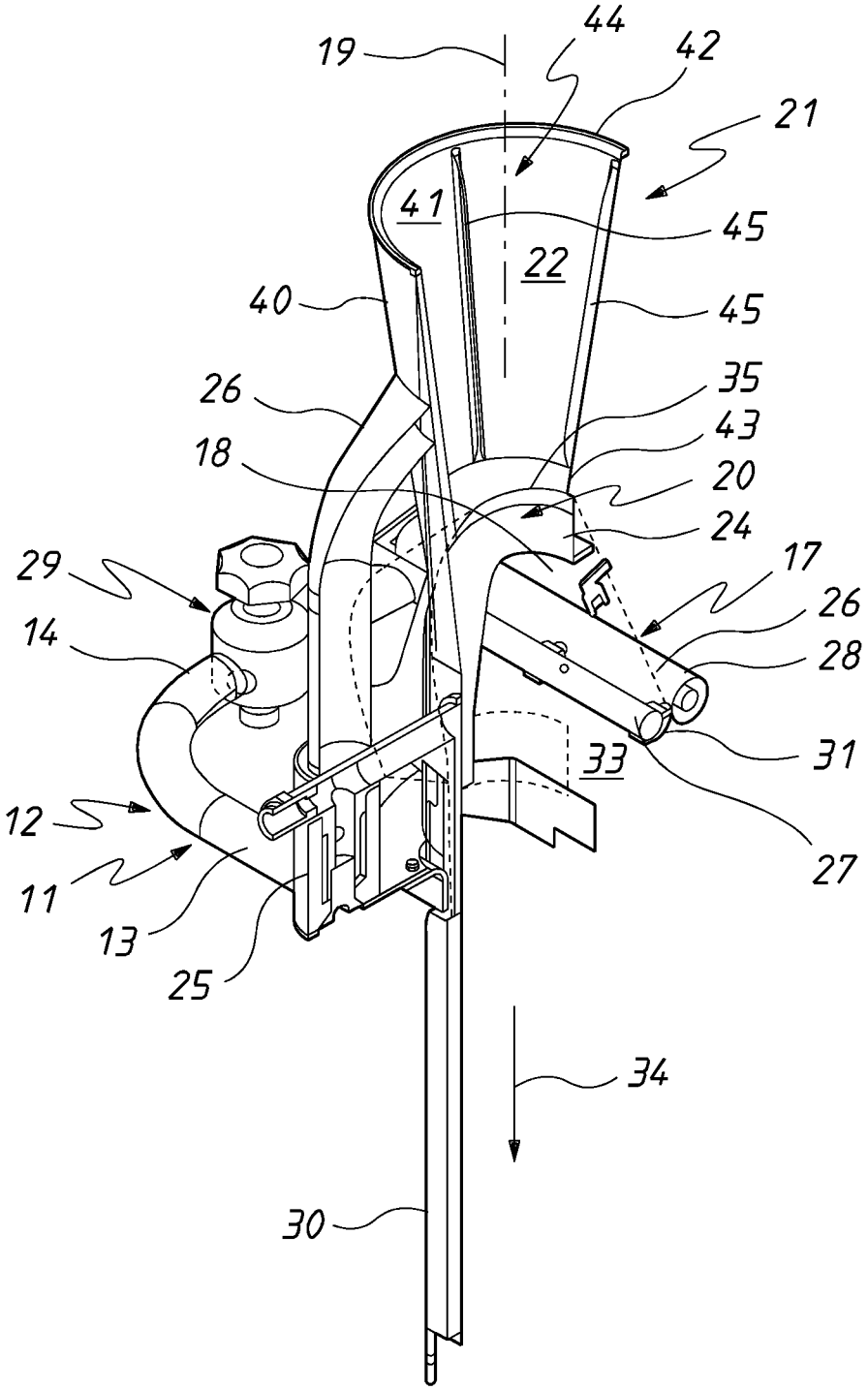
FIG. 2 is a schematic vertical sectioned isometric view of the assembly of FIG. 1.
Figures 3, 4, 5, 6:
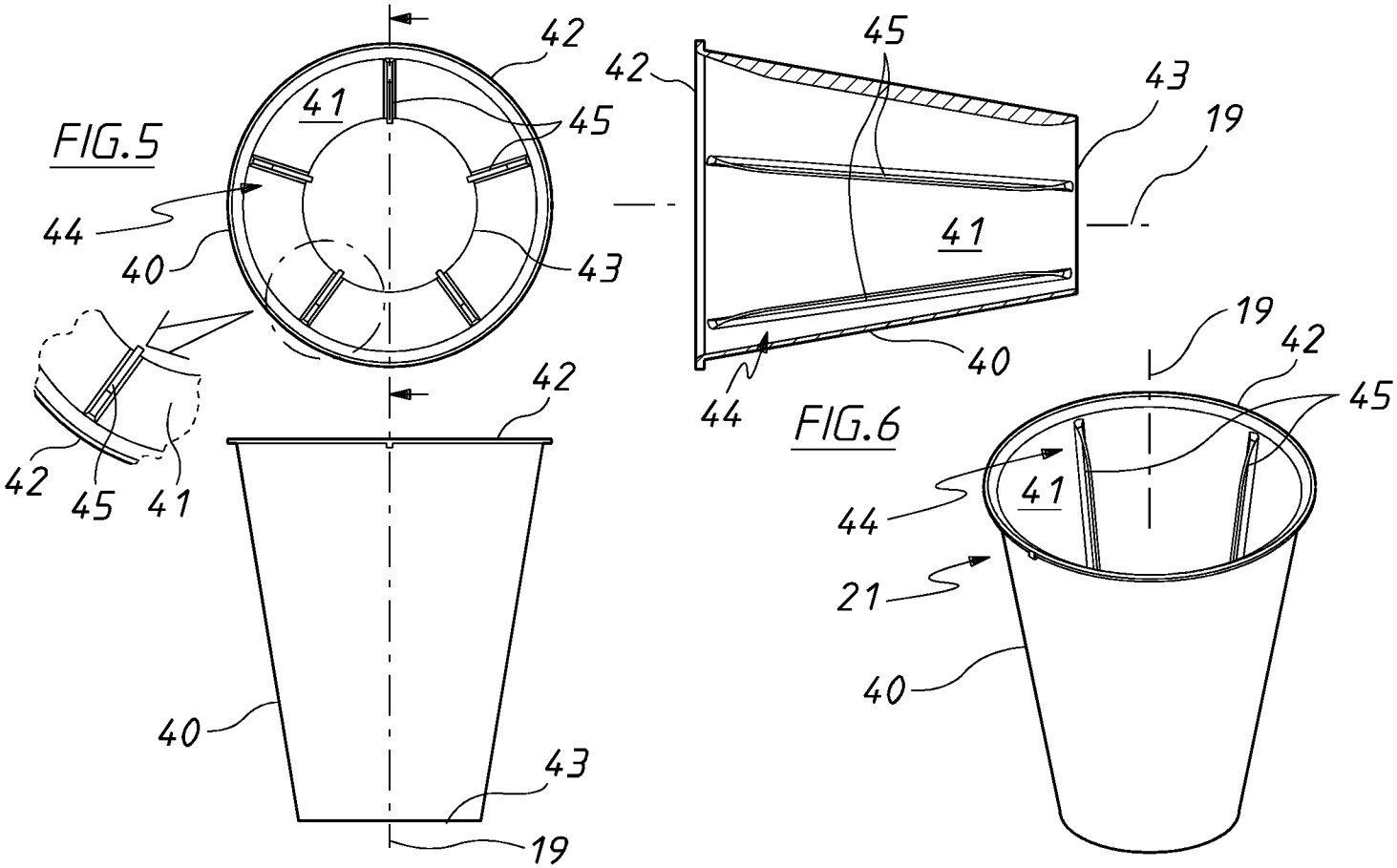
FIG. 3 is a schematic isometric view of a tubular sheet of the assembly of FIGS. 1 and 2.
FIG. 4 is a schematic side elevation of the tubular chute of FIG. 3.
FIG. 5 is a schematic top plan view of the tubular chute as shown in FIG. 4.
FIG. 6 is a schematic sectioned side elevation of the tubular chute as shown in FIG. 5 sectioned along the line 6-6.

In the attached drawings there is schematically depicted a former assembly 10 for a packaging machine, such as that described in U.S. Pat. Nos. 5,622,032, 7,159,376 and 4,753,336. There is particularly described in U.S. patent application Ser. No. 13/421,596, a former assembly, of which the preferred embodiment described below is an improvement.

The former assembly 10 includes a frame 11 including a first frame member 12 that is of a "U-shaped" configuration so as to have a base 13 from which there extends diverging arms 14. The frame member 12 is tubular in construction so as to have a longitudinally extending passage to which a gas may be delivered.

The frame 11 further includes transverse support members 16 fixed to end portions 15 of the arms 14, the member 16 extending inwardly relative to the upright central axis 19.

Supported by the frame 11 is a former shoulder 17 (shown in "hidden lines") having a former surface 18 over which strip bag material 32 passes to be formed into a tubular configuration 23. The surface 18 faces outwardly away from the axis 19, and generally surrounds the axis 19, and converges upwardly towards the axis 19 to form a former opening 20 through which the axis 19 passes. Extending toward the opening 20 is a product delivery tubular chute 21 having an interior 22 to which product is delivered for delivery to the interior of the tubular bag material 23 from which bags of product are formed.

The opening 20 is located adjacent the lower end the chute 21 so that bag material engaged with and moving upwardly over the surface 18 is allowed to be redirected downwardly through the opening 20 to then extend in the direction 34 to the packaging machine below.

The surface 18 extends upwardly and terminates at the opening 20 with a ridge 35 adjacent the opening 20. The ridge 35 is in the form of an arcuate edge. A tubular portion 24 of the former 17 extends downwardly from the ridge 35. The tubular bag material 23 slides downwardly inside the tubular portion 24 of the former shoulder 17 for delivery to the packaging machine below. The portion 24 may be part or full tubular in configuration.

The former shoulder 17 is supported by the members 16 by being fixed to the tubular portion 24 of the former shoulder 17.

The frame 11 further includes a central mounting 25 fixed to the base 13 so as to extend upwardly therefrom. Fixed to the mounting 25 is an upwardly extending support 26 fixed at its upper end to the product delivery chute 21 to support the chute 21. The chute 21 may also be attached to the mounting 25 so as to be further supported thereby.

The former 17 has a peripheral transverse length 31 that is folded so as to aid in increasing the rigidity of the former shoulder 17. This transverse length 31 is secured to a transverse member 27 fixed to the end portions 15. A roller 28 is located adjacent to but spaced from the transverse portion 26 to aid in the delivery of the sheet bag material 32 to the surface 18. The former shoulder 17 is therefore supported by the arms 14.

One or both of the arms 15 is provided with a coupling 29 via which a gas can be delivered to the interior of the member 12. As the member 12 is of a tubular construction, the gas can be delivered to the mounting portion 25 from where it is delivered to a backing member 30 (extending from the tubular portion 24) for delivery of gas to the interior of the tubular bag material. If so required, the member 26 may also be tubular for the delivery of a gas to the interior of the product delivery chute 21.

The tubular portion 24 has a recess 33 that provides access to the film when the film is initially being fed into the tubular portion 24.

The chute 21 includes a body 40, surrounding the generally upright central longitudinal axis 19. The body 40 is preferably formed of sheet metal, and has an internal surface 41 surrounding the axis 19. Preferably, the body 40 is of a frusto-conical configuration so as to converge downwardly from an upper rim 42 to a lower rim 43. Accordingly the body 40 is circular in transverse cross-section. The lower rim 43 is adjacent the opening 20. However it should be appreciated that the lower rim 43 terminates above the opening 20, so as to leave a gap through which the bag material 32 may pass to be located internally of the tubular portion 24 after passing over the ridge 35.

As mentioned above, preferably the body 40 is of a frusto-conical configuration. Accordingly, it is preferably for the surface 41 to converge downwardly to the rim 43 relative to the axis 19.

Attached to or formed integral with the body 41 is a plurality of projections 44. The projections 44 are most preferably ridges 45.

The projections 44 are located at angularly spaced locations about the axis 19 and preferably have their major direction of extension generally parallel to the axis 19.

Most preferably, the projections 44, are ridges 45 as discussed above, in which case the ridges 45 have the major direction of extension generally parallel to the axes 19, but also extend radially inwardly relative to the axis 19 so as to have a minor direction of extension that is radial relative to the axis 19. Most preferably, the ridges 45 do not have any angular direction of extension about the axis 19.

The above described preferred embodiment has the advantage of reducing angular movement of the product batches about the axis 19. This is achieved by the product batches engaging the projections 45 to inhibit their angular movement about the axis 19. By inhibiting movement of the batches about the axis 19, batch elongation is reduced, while speed of the batches is enhanced since less energy is lost in rotational energy.

The invention claimed is:

1. A former assembly for a packaging machine, the assembly including:

a frame to be fixed relative to the packaging machine so that the assembly can deliver tubular bag material to the packaging machine;

a former shoulder mounted on the frame, the former shoulder being provided to receive strip bag material and reconfigure the strip bag material into the tubular bag material, the former shoulder includes a former surface over which the strip bag material passes to be reconfigured, the former surface converging upwardly to a former opening through which the tubular bag material passes; and a product delivery chute comprising a body extending downwardly from an upper rim of the body to a lower rim of the body adjacent the opening, wherein the product delivery chute is configured to receive a batch of solid product and deliver the batch of solid product to an interior of the tubular bag material;

wherein the product delivery chute and former shoulder have a generally upright central longitudinal axis, wherein the product delivery chute is configured so that the batch of solid product flows downwardly along an internal chute surface of the body to the former shoulder, wherein the internal chute surface of the body is frusto-conical in shape and surrounds said longitudinal axis, wherein the product delivery chute further comprises a plurality of projections connected to and extending perpendicularly from the internal chute surface of the body;

wherein each projection extends inwardly toward said longitudinal axis so that each projection defines a first side connected to the internal chute surface of the body and an edge, opposite the first side, facing the longitudinal axis, wherein each edge of each projection is not coupled to other elements of the product delivery chute so that the product delivery chute is not partitioned into distinct portions, wherein each projection of the plurality of projections extends along the internal chute surface of the body from the upper rim to the lower rim in a respective direction coplanar to said longitudinal axis, and wherein the plurality of projections are configured to engage the batch of solid product to inhibit angular movement of the solid product about said longitudinal axis as the batch of solid product falls through the product delivery chute along the internal chute surface from the upper rim to the lower rim and between the plurality of projections.

2. The former assembly of claim 1, wherein the projections are located at angularly spaced positions about said longitudinal axis, and wherein a distance between the angularly spaced positions is greater than a distance the projections extend away from the internal chute surface of the body.

3. The former assembly of claim 2, wherein each projection extends a first distance in said respective direction and extends a second distance perpendicular to said respective direction, and wherein the first distance is greater than the second distance.

4. The former assembly of claim 3, wherein said internal chute surface converges downwardly toward said longitudinal axis.

5. The former assembly of claim 3, wherein said internal chute surface is generally circular in transverse cross-section, with the delivery chute including a tube body providing said internal chute surface, with each projection being attached to said tube body.

6. The former assembly of claim 2, wherein said internal chute surface converges downwardly toward said longitudinal axis.

7. The former assembly of claim 6, wherein each projection extends a first distance in said respective direction and extends a second distance perpendicular to said respective direction, wherein the first distance is greater than the second distance, and wherein said internal chute surface converges downwardly toward said longitudinal axis.

8. The former assembly of claim 2, wherein said internal chute surface is generally circular in transverse cross-section.

9. The former assembly of claim 2, wherein each projection does not extend angularly about said longitudinal axis.

10. The former assembly of claim 2, wherein the angular spacing is between 20° and 90°.

11. The former assembly of claim 10, wherein the angular spacing is about 72°.

12. The former assembly of claim 1, wherein each projection extends a first distance in said respective direction and extends a second distance perpendicular to said respective direction, and wherein the first distance is greater than the second distance.

13. The former assembly of claim 1, wherein said internal chute surface converges downwardly toward said longitudinal axis.

14. The former assembly of claim 1, wherein said internal chute surface is generally circular in transverse cross-section.

15. The former assembly of claim 1, wherein each projection does not extend angularly about said longitudinal axis.

16. The former assembly of claim 1, wherein a lower portion of the opposite edge converges toward the internal chute surface.

17. A method of providing tubular bag material and product to a packaging machine, the method including the steps of:

receiving, at a former shoulder, strip bag material and reconfiguring the strip bag material into tubular bag material by passing the strip material over a former surface that converges upwardly to a former opening through which the tubular bag material passes;

receiving, at a product delivery chute comprising a body extending downwardly from an upper rim of the body to a lower rim of the body adjacent the former opening, solid product to be delivered downwardly along a frustoconical shaped internal chute surface of the delivery chute to the former shoulder and thereby to an interior of the tubular bag material, the product delivery chute and former shoulder having a generally upright central longitudinal axis and the solid product having an angular movement about the longitudinal axis, inhibiting angular movement of the solid product about the longitudinal axis as the solid product falls along the internal surface using a plurality of projections connected to and extending from the internal chute from the upper rim to the lower rim, wherein each projection extends perpendicularly from the internal chute surface of the body and inwardly toward said longitudinal axis so that each projection defines a first side connected to the internal chute surface of the body and an edge, opposite the first side, facing the longitudinal axis, and wherein each edge of each projection is not coupled to other elements of the product delivery chute so that the product delivery chute is not partitioned into distinct portions.

* * * * *